US008217975B2

(12) United States Patent
Kleckner et al.

(10) Patent No.: US 8,217,975 B2
(45) Date of Patent: Jul. 10, 2012

(54) APPARATUS FOR FORMING AN IMAGE AND CORRESPONDING METHODS

(75) Inventors: Robert J. Kleckner, Pittsford, NY (US); Patrick Yasuo Maeda, Mountain View, CA (US); Martin Pepe, W. Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 1135 days.

(21) Appl. No.: 12/060,513

(22) Filed: Apr. 1, 2008

(65) Prior Publication Data

US 2009/0244252 A1 Oct. 1, 2009

(51) Int. Cl.
*B41J 2/455* (2006.01)

(52) U.S. Cl. ..... 347/233; 347/224; 347/225; 347/226; 347/236

(58) Field of Classification Search ..... 347/224–264
See application file for complete search history.

(56) References Cited

U.S. PATENT DOCUMENTS 5,319,393 A 6/1994 Genovese
5,471,236 A * 11/1995 Ito ..... 347/233
5,550,668 A * 8/1996 Appel et al. ..... 359/204.1
5,589,870 A * 12/1996 Curry et al. ..... 347/233
5,638,107 A * 6/1997 Curry ..... 347/234
5,995,267 A * 11/1999 Paoli ..... 359/204.1
6,038,051 A * 3/2000 Suzuki et al. ..... 359/204.1
6,049,408 A * 4/2000 Tada ..... 359/204.1
6,057,953 A * 5/2000 Ang ..... 359/204.1
6,078,341 A * 6/2000 Rees et al. ..... 347/129
6,104,523 A * 8/2000 Ang ..... 359/216.1
6,115,165 A * 9/2000 Tada ..... 359/204.1
6,137,522 A * 10/2000 Melino et al. ..... 347/233
6,160,610 A * 12/2000 Toda ..... 355/41
2006/0092264 A1 * 5/2006 Matsuzaki et al. ..... 347/233

* cited by examiner

*Primary Examiner* — Ryan Lepisto
*Assistant Examiner* — Guy Anderson
(74) *Attorney, Agent, or Firm* — Ronald E. Prass, Jr.; Prass LLP

(57) ABSTRACT

Disclosed are an apparatus, optical scanning device, and a corresponding method of forming images on a photosensitive surface. The apparatus includes a laser raster output scanner (ROS) including laser emitters arranged to simultaneously scan a plurality of laser beams across a single scan line of the photosensitive surface in response to received image data corresponding to pixels in an image to be reproduced, and a controller individually controlling each of the laser emitters to selectively apply one of a plurality of power levels to each of the laser beams based on the image data for each of the pixels, wherein a total power applied by the laser beams for each pixel is determined by a sum of the power levels applied by each of the laser beams.

11 Claims, 6 Drawing Sheets

| STATE | LASER NUMBER | | | | EXPOSURE POWER |
|---|---|---|---|---|---|
| | 1 | 2 | 3 | 4 | |
| 1 | | | | | 0.00 |
| 2 | 1.000 | | | | 1.00 |
| 3 | | 1.000 | | | 1.00 |
| 4 | | | 1.000 | | 1.00 |
| 5 | | | | 1.000 | 1.00 |
| 6 | 1.000 | 1.000 | | | 2.00 |
| 7 | 1.000 | | 1.000 | | 2.00 |
| 8 | | 1.000 | 1.000 | | 2.00 |
| 9 | 1.000 | | | 1.000 | 2.00 |
| 10 | | 1.000 | | 1.000 | 2.00 |
| 11 | | | 1.000 | 1.000 | 2.00 |
| 12 | 1.000 | 1.000 | 1.000 | | 3.00 |
| 13 | 1.000 | 1.000 | | 1.000 | 3.00 |
| 14 | 1.000 | | 1.000 | 1.000 | 3.00 |
| 15 | | 1.000 | 1.000 | 1.000 | 3.00 |
| 16 | 1.000 | 1.000 | 1.000 | 1.000 | 4.00 |

| STATE | LASER NUMBER | | | | NORMALIZED EXPOSURE POWER |
|---|---|---|---|---|---|
| | 1 (WEAKEST) | 2 | 3 | 4 (HIGHEST) | |
| 1 | | | | | 0.00 |
| 2 | 0.067 | | | | 0.07 |
| 3 | | 0.133 | | | 0.13 |
| 4 | 0.067 | 0.133 | | | 0.20 |
| 5 | | | 0.267 | | 0.27 |
| 6 | 0.067 | | 0.267 | | 0.33 |
| 7 | | 0.133 | 0.267 | | 0.40 |
| 8 | 0.067 | 0.133 | 0.267 | | 0.47 |
| 9 | | | | 0.533 | 0.53 |
| 10 | 0.067 | | | 0.533 | 0.60 |
| 11 | | 0.133 | | 0.533 | 0.67 |
| 12 | 0.067 | 0.133 | | 0.533 | 0.73 |
| 13 | | | 0.267 | 0.533 | 0.80 |
| 14 | 0.067 | | 0.267 | 0.533 | 0.87 |
| 15 | | 0.133 | 0.267 | 0.533 | 0.93 |
| 16 | 0.067 | 0.133 | 0.267 | 0.533 | 1.00 |

APPARATUS FOR FORMING AN IMAGE AND CORRESPONDING METHODS

BACKGROUND

Disclosed herein are an apparatus for forming an image and corresponding methods.

In laser printing, such as is employed in a digital copier, a laser beam printer, or the like, laser light is used to expose a photoreceptor in an image wise fashion. In a conventional rotating mirror laser scanner, the exposure pattern is typically binary such that at any given point in the scanned image the laser emitter is either "on" or "off". Because the emitter is either on or off, certain image quality defects can be produced. To attenuate some of these defects, the addressability of the scanner may be increased.

Some laser printers utilize simultaneous writing with a plurality of laser beams. This could enable higher addressability, higher process speed or both. Typically, the lasers have been arranged such that each beam will scan a different scan line. For example, eight lasers could scan eight scan lines simultaneously. In some applications, multiple beams have been used to overwrite an exposed profile to correct for various non-uniformities such as beam power non-uniformity and misalignment. This typically occurs when a scan line is scanned a second time by a different laser beam during a subsequent scan.

SUMMARY

According to aspects of the embodiments, there is provided an apparatus, optical scanning device, and a corresponding method of forming images on a photosensitive surface. The apparatus includes a laser raster output scanner (ROS) including laser emitters arranged to simultaneously scan a plurality of laser beams across a single scan line of the photosensitive surface in response to received image data corresponding to pixels in an image to be reproduced, and a controller individually controlling each of the laser emitters to selectively apply one of a plurality of power levels to each of the laser beams based on the image data for each of the pixels, wherein a total power applied by the laser beams for each pixel is determined by a sum of the power levels applied by each of the laser beams.

DETAILED DESCRIPTION

While the present invention will be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

The disclosed embodiments include an apparatus for forming an image on a photosensitive surface. The apparatus includes a laser raster output scanner (ROS) including laser emitters arranged to simultaneously scan a plurality of laser beams across a single scan line of the photosensitive surface in response to received image data corresponding to pixels in an image to be reproduced, and a controller individually controlling each of the laser emitters to selectively apply one of a plurality of power levels to each of the laser beams based on the image data for each of the pixels, wherein a total power applied by the laser beams for each pixel is determined by a sum of the power levels applied by each of the laser beams.

The disclosed embodiments further include a method of forming images on a photosensitive surface with an apparatus having a laser raster output scanner (ROS) including laser emitters. The method includes simultaneously scanning a plurality of laser beams emitted from the laser emitters across a single scan line of the photosensitive surface in response to received image data corresponding to pixels in an image to be reproduced, and individually controlling each of the laser emitters to selectively apply one of a plurality of power levels to each of the laser beams based on the image data for each of the pixels, wherein a total power applied by the laser beams for each pixel is determined by a sum of the power levels applied by each of the laser beams.

The disclosed embodiments further include an optical scanning device for forming an image on a photosensitive surface. The optical scanning device includes a laser raster output scanner (ROS) including laser emitters that simultaneously scan a plurality of laser beams across a single scan line of the photosensitive surface, and a controller individually controlling each of the laser emitters based on image data to apply one of a plurality of power levels from each of the laser beams to each of a plurality of pixels across the scan line, wherein the controller controls a power level of each of the laser beams to selectively apply one of a plurality of gray levels to each of the pixels.

Figure 1:
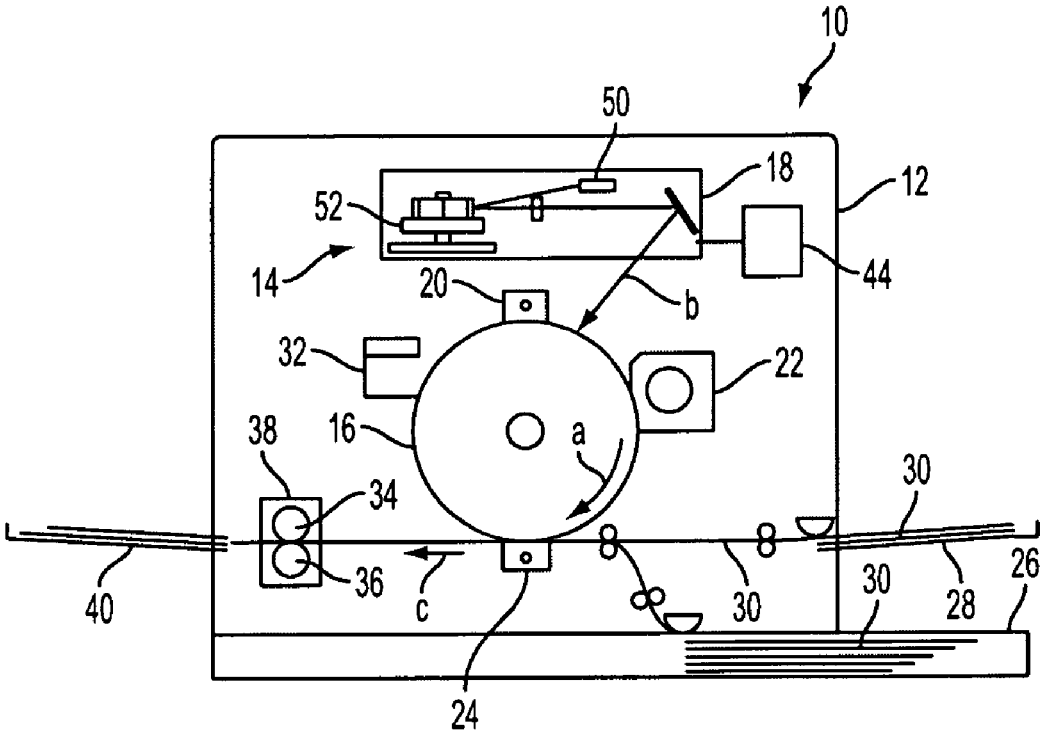
FIG. 1 illustrates a schematic view of a digital imaging system.

FIG. 1 is a diagram showing a general structure of an image forming apparatus 10. The image forming apparatus may be a laser printer, laser copier, or the like. The image forming apparatus 10 may be enclosed within a housing 12.

An image forming section 14 may be provided within housing 12. The image forming section 14 may include a photoreceptor 16 and an optical scanning device 18. The optical scanning device may be a laser Raster Output Scanner (ROS). The photoreceptor 16 may rotate in a direction of arrow a as shown in FIG. 1. The optical scanning device 18 may direct light beams (laser) based on received image data corresponding to pixels in an image to be reproduced toward the photoreceptor 16 (in the direction of arrow b) while scanning.

A charging unit 20 may be disposed in a peripheral surface vicinity of the photoreceptor 16. The charging unit 20 charges the photoreceptor 16 as a result of the photoreceptor 16 rotating in the direction of arrow a. Polygon mirror 52 rotates causing beams b to scan along a path that is parallel to an axis of photoreceptor 16. The intensities of the beams are modulated in an image wise fashion as they are scanned, selectively discharging the photoreceptor 16, thereby creating a latent image on the photoreceptor 16. Controller 44 may, among other functions, control the on/off timing and power levels of the various laser emitters to produce a desired output based on the image data.

A developing unit 22 may supply toner to photoreceptor 16 at a downstream side in a direction of rotation of photoreceptor 16 from a position of irradiation by the laser beam or beams from the optical scanning device 18. As a result, a toner image is formed on the peripheral surface of the photoreceptor 16.

A transfer charger 24 is disposed facing the peripheral surface of the photoreceptor 16 from a position at which the developing unit 22 is disposed (at a position vertically below an axial center of photoreceptor 16). The transfer charger 24 transfers the toner image formed on the peripheral surface of the photoreceptor 16 to paper 30, which is guided between the photoreceptor 16 and the transfer charger 24 from a paper tray 26 or a manual feed tray 28.

A cleaner 32 may be disposed facing the photoreceptor 16, at a downstream side in the rotation direction of the photoreceptor 16 from the position at which the transfer charger 24 is disposed. Toner remaining at the peripheral surface of the photoreceptor 16 after transfer is removed by the cleaner 32.

The paper 30 to which the toner image has been transferred is ejected in the direction of arrow c. A fixing unit 38, which is structured to include a pressure roller 34 and a heating roller 36, is disposed at a downstream side from the photoreceptor 16 in the direction of ejection of the paper 30. At the fixing unit 38, the paper 30 to which the toner image has been transferred and which is being ejected is subjected to pressure and heated, and the toner is fixed by melting. That is, a "fixing process" is performed at the fixing unit 38, and the predetermined image is recorded on the paper 30. The fixing process is achieved, and the paper on which the image has been recorded is ejected to a discharge tray 40 or the like.

The optical scanning device 18 can be provided with an array-form semiconductor laser 50 (laser array), and a rotating polygon multi-faced mirror 52. The polygon mirror 52 may be formed in a regular polygon shape and provided with a plurality of reflection surfaces at side faces thereof, and can be rotated at high speed by a motor (not shown). The laser array 50 can be a vertical cavity surface emitting laser (VCSEL) in which a plurality of laser emitters are arranged in two dimensions.

The VCSEL can include a multi-spot laser diode in which the plurality of laser emitters are arranged in two dimensions. In one arrangement, the multi-spot laser diode can have a total of thirty-two laser emitters disposed two-dimensionally with predetermined spacings, with eight laser emitters in a main scanning direction by four in a sub-scanning direction. Any number of emitters could be used, and the arrangement mentioned is only one possible arrangement. The light emitting device 50 can be a single edge emitting laser diode having a multiplicity of emitters on a single chip. The scanning function, shown implemented by a rotating polygon mirror 52, could also be implemented using an oscillating galvanometer or a micro-electro-mechanical system.

The foregoing description illustrates the general operation of an image forming apparatus incorporating embodiments of the present disclosure therein. Not all of the elements discussed in conjunction with FIG. 1 are necessarily needed for effective use of the invention. Instead, these elements are described as a machine within which embodiments of the invention could operate.

Figure 2:
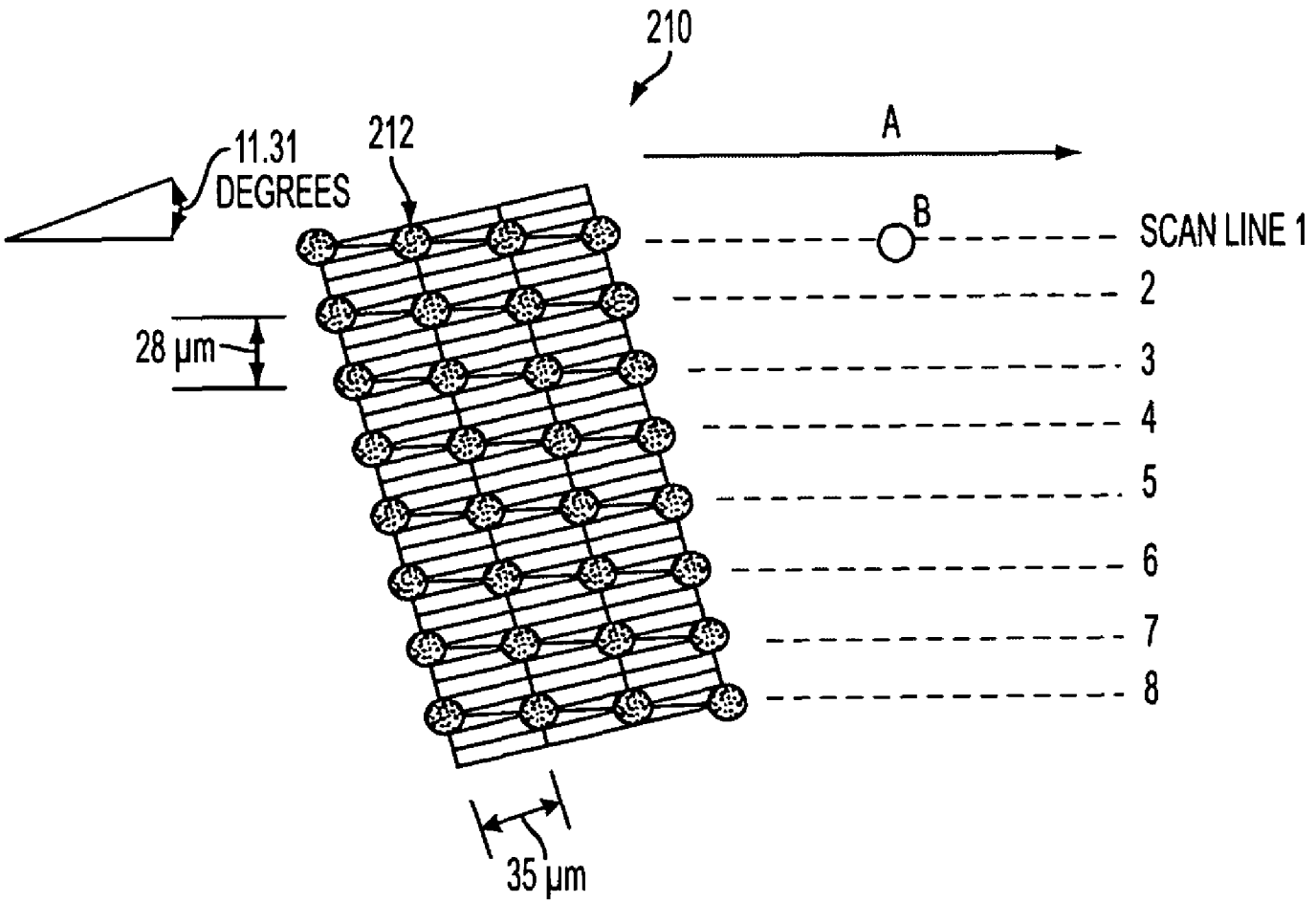
FIG. 2 illustrates a diagram of a laser array.

FIG. 2 illustrates a laser array 210. The laser array 210 includes a plurality of laser emitters 212 arranged in a grid pattern. Each of the laser emitters 212 emits a laser beam which is directed along a scan line. In the FIG. 2 embodiment, thirty-two laser emitters are used in a 4×8 grid, although there is a multiplicity of combinations of lasers and grid patterns that could be employed. Such a laser array could be used so as to direct a laser beam from each of the laser emitters along a different scan line. Alternatively, by tilting the array 210 as shown in FIG. 2, a plurality of the laser emitters can be aligned to direct the laser beams simultaneously along a same scan line so that overwriting of multiple beams across each scan line may occur.

In the example shown in FIG. 2, the array may be tilted at approximately 11.31 degrees to align four of the laser emitters along each of scan lines 1 through 8. For example, the four topmost laser emitters in FIG. 2 are aligned along scan line 1, and cause the four laser beams to scan across scan line 1 in the direction of arrow A. At any spot along scan line 1, such as spot B, each of the laser beams may be on or off. By controlling various combinations of the four laser beams being on or off, different exposure levels may be created at any and all points on the scan line. Further, by using a plurality of laser beams to scan each scan line, the laser beams re-expose or overwrite a previous exposure by a different laser beam. The power level of each laser beam may also be controlled by the controller controlling the emitters based on the image data to control the exposure of each spot along the scan line. By controlling the power levels in this way, a gray level applied at each spot or pixel may be controlled.

In the example of FIG. 2, the laser emitters along a scan line may be separated by 35 μm, with each scan line separated by 28 μm. These distances are only examples, and other separations could be used depending on desired resolution, speed, and the like.

Figures 3, 4:
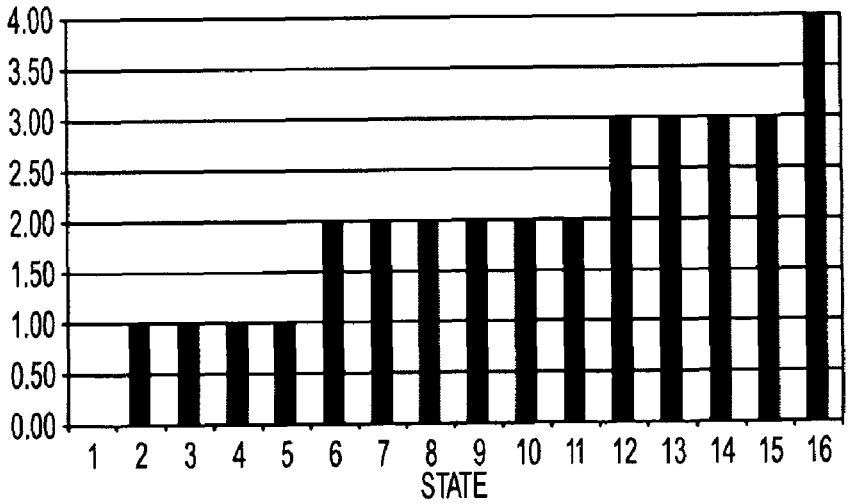
FIG. 3 illustrates a table of laser power levels.
FIG. 4 illustrates a chart of laser power levels.

FIG. 3 illustrates a table in which each of the laser beams has a power level of 0 or 1. In FIG. 3, the 16 possible combinations of possible on/off states for the four laser beams of each scan line, and their total power level, are illustrated. This data is further shown in chart form in FIG. 4. If each of the four laser beams of each row has a power output of 1 or 0, there are five unique exposure levels: 0, 1, 2, 3 and 4, and several combinations yield the same total power level. Accordingly, for any desired total power level, different combinations of on/off among the lasers may be selected by the controller so as to not overuse any of the lasers. For example, to get a desired power level of 2, any two of the four lasers may be on and any two may be off.

Figures 5, 6:
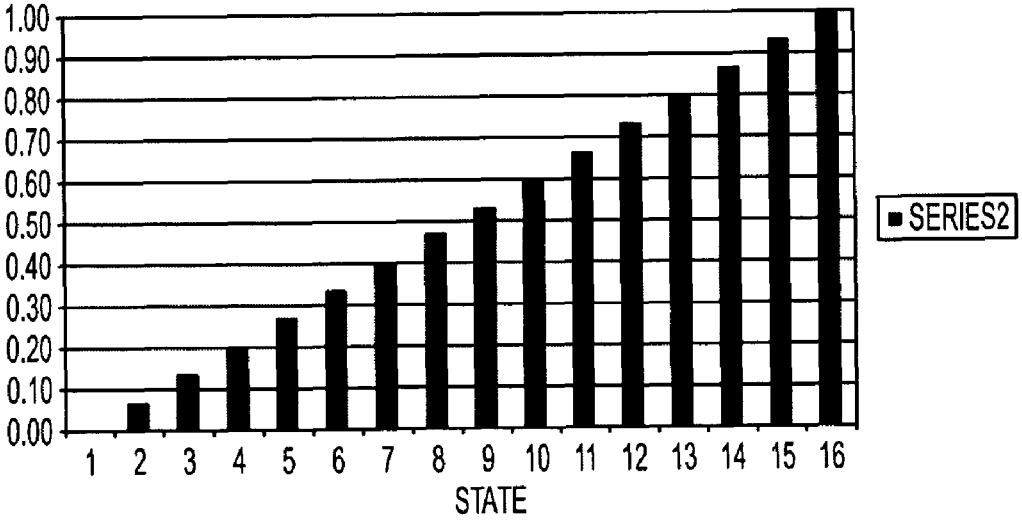
FIG. 5 illustrates a table laser power levels.
FIG. 6 illustrates a chart of laser power levels.

FIG. 5 illustrates a table in which each of the laser emitters emits a beam having a power level which has been determined to achieve sixteen different total power levels that vary linearly, and are substantially linearly spaced, with the maximum total power level for all four laser beams being normalized to one unit. FIG. 6 shows the same data in chart form. By setting the power levels as shown in FIGS. 5 and 6, this allows sixteen total power levels and sixteen different gray levels to be produced by four laser beams scanning and overwriting each scan line. By using the laser array of FIG. 2 having 32 laser emitters with four laser beams arranged in each of eight rows and the power levels shown in FIGS. 5 and 6, the embodiments can simultaneously scan eight scan lines with overwrite of four laser beams for each scan line and produce any of the sixteen desired total power levels for each spot or pixel in the scan line. The sixteen total power levels can produce sixteen different gray levels for each pixel.

Any number of laser emitters could be used in the laser array. For example, the array could be 4×32 to scan thirty-two lines simultaneously. Alternatively, to produce more output levels, five or more laser beams could be used to scan each row.

Further, embodiments may alter the weightings of the power levels to produce non-liner power levels as needed. For example, the power levels for the laser beams from any of the laser emitters may be set by the controller to any level to, for example, compensate for photoreceptor or image non-linearities.

Figure 7:
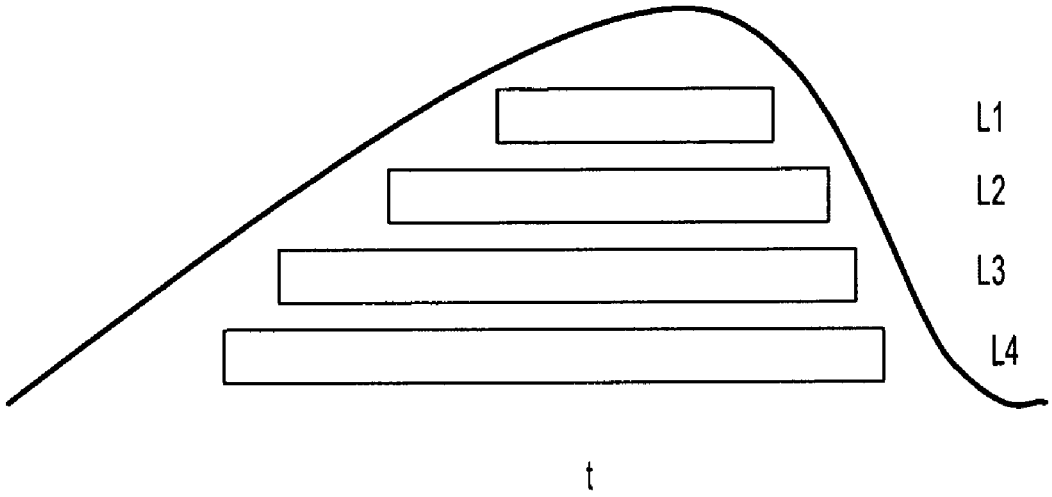
FIG. 7 illustrates an exposure envelope for lasers scanning a scan line.

FIG. 7 illustrates an exposure envelope for four laser beams scanning a particular spot on a scanning line. Embodiments may utilize the controller to control and vary the on timing and off timing of the laser beams as they scan a spot along a scan line to produce a scan envelope varying with time as desired across the particular spot. This allows variation in the exposure level (and hence the gray level) within each pixel. This exposure envelope may be applied at a pixel (or spot) level, at a sub-pixel level, or across multiple pixels.

The VCSEL array has been described as an emitter that may be used. However, alternative emitters may also be used, such as a dual beam monolithic emitter, which may be used to scan single lines with two laser beams having four unique power levels. Also, a quad beam emitter could be used to scan a single scan line at a time with four laser beams and produce 16 unique levels with overwrite.

Figure 8:
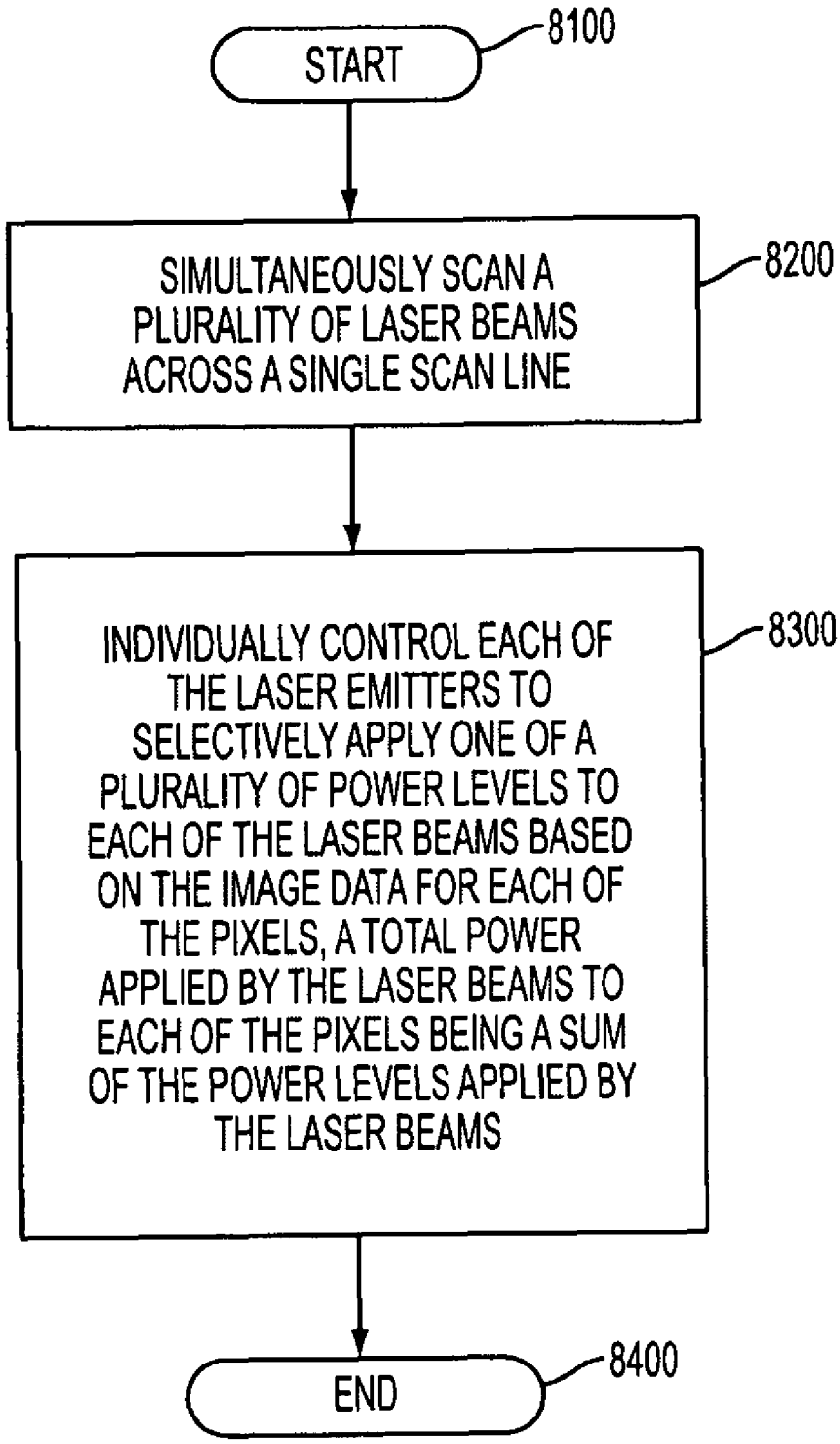
FIG. 8 is a flowchart illustrating a method of forming images with an apparatus such as an optical scanning device.

FIG. 8 illustrates a flowchart of a method for forming images on sheets in an electrophotographic apparatus. The method starts at 8100. At 8200, a plurality of laser beams emitted from the laser emitters are simultaneously scanned across a single scan line of the surface in response to received image data corresponding to pixels in an image to be reproduced.

At 8300, each of the laser emitters is individually controlled to selectively apply one of a plurality of power levels from each of the laser beams based on the image data for each of the pixels, wherein a total power applied by the laser beams for each pixel is determined by a sum of the power levels applied by each of the laser beams. At 8400, the method stops.

Embodiments as disclosed herein may include computer-readable medium for carrying or having computer-executable instructions or data structures stored thereon. Such computer-readable medium can be any available medium that can be accessed by a general purpose or special purpose computer, and may be connected to or associated with controller 44. By way of example, and not limitation, such computer-readable medium can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable medium.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. The instructions for carrying out the functionality of the disclosed embodiments may be stored on such a computer-readable medium.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An apparatus for forming an image on a photosensitive surface, comprising: a laser raster output scanner (ROS) including laser emitters arranged to simultaneously scan a plurality of laser beams across a single scan line of the photosensitive surface in response to received image data corresponding to pixels in an image to be reproduced; and a controller individually controlling each of the laser emitters to selectively apply one of a plurality of power levels to each of the laser beams based on the image data for each of the pixels, wherein a total power applied by the laser beams for each pixel is determined by a sum of the power levels applied by each of the laser beams, wherein the controller selects either the power levels for each of the laser emitters for each pixel from among five different power levels, or selects the power levels for each of the laser emitters to achieve a total power level applied to each pixel from among sixteen different total power levels, the sixteen different total power levels being substantially linearly spaced.

2. The apparatus of claim 1, wherein the laser emitters are arranged so as to simultaneously scan the plurality of laser beams across each of a plurality of scan lines.

3. The apparatus of claim 1, wherein the laser raster output scanner comprises thirty-two light emitters arranged so as to simultaneously scan thirty-two laser beams across eight scan lines, wherein four different ones of the thirty-two laser beams are simultaneously scanned across each of the eight scan lines.

4. The apparatus of claim 1, wherein the controller controls an on time and an off time of the laser emitters as they scan individual ones of the pixels to further control a total power level applied to each pixel.

5. A method of forming images on a photosensitive surface with an apparatus having a laser raster output scanner (ROS) including laser emitters, comprising: simultaneously scanning a plurality of laser beams emitted from the laser emitters across a single scan line of the photosensitive surface in response to received image data corresponding to pixels in an image to be reproduced; and individually controlling each of the laser emitters to selectively apply one of a plurality of power levels to each of the laser beams based on the image data for each of the pixels, wherein a total power applied by the laser beams for each pixel is determined by a sum of the power levels applied by each of the laser beams; selecting either the power levels for each of the laser emitters for each pixel from among five different power levels; or selecting the power levels for each of the laser emitters to achieve a total power level applied to each pixel from among sixteen different total power levels, wherein the sixteen different total power levels are substantially linearly spaced.

6. The method of claim 5, wherein the plurality of laser emitters are arranged so as to simultaneously scan the plurality of laser beams across each of a plurality of scan lines.

7. The method of claim 5, wherein the laser raster output scanner comprises thirty-two light emitters arranged so as to simultaneously scan thirty-two laser beams across eight scan lines, wherein four different ones of the thirty-two laser beams are simultaneously scanned across each of the eight scan lines.

8. The method of claim 5, further comprising controlling an on time and an off time of the laser emitters as they scan individual ones of the pixels to further control a total power level applied to each pixel.

9. An optical scanning device for forming an image on a photosensitive surface, comprising: a laser raster output scanner (ROS) including laser emitters that simultaneously scan a plurality of laser beams across a single scan line of the photosensitive surface; and a controller individually controlling each of the laser emitters based on image data to apply one of a plurality of power levels from each of the laser beams to each of a plurality of pixels across the scan line, wherein the controller controls a power level of each of the laser beams to selectively apply one of a plurality of gray levels to each of the pixels, wherein the controller selects either the power levels for each of the laser emitters for each pixel from among five different power levels, or selects the power levels for each of the laser emitters to achieve a total power level applied to each pixel from among sixteen different total power levels, the sixteen different total power levels being substantially linearly spaced.

10. The optical scanning device of claim 9, wherein the laser raster output scanner simultaneously scans thirty-two laser beams across eight scan lines, wherein four different ones of the thirty-two laser beams are simultaneously scanned across each of the eight scan lines.

11. The optical scanning device of claim 9, wherein the controller controls an on time and an off time of the laser emitters as they scan individual ones of the pixels to further control the total power level applied to each pixel.

* * * * *